US005897614A

United States Patent [19]

McKiel, Jr.

[11] Patent Number: 5,897,614

[45] Date of Patent: Apr. 27, 1999

[54] METHOD AND APPARATUS FOR SIBILANT CLASSIFICATION IN A SPEECH RECOGNITION SYSTEM

[75] Inventor: Frank Albert McKiel, Jr., Plano, Tex.

[73] Assignee: International Business Machines Corporation, Armonk, N.Y.

[21] Appl. No.: 08/770,881

[22] Filed: Dec. 20, 1996

[51] Int. Cl.[6] ..... G10L 9/02

[52] U.S. Cl. ..... 704/208; 704/209

[58] Field of Search ..... 704/231, 208, 704/214, 266, 250, 209, 207

[56] References Cited

U.S. PATENT DOCUMENTS

| | | | |
|---|---|---|---|
| 3,989,896 | 11/1976 | Reitboeck | 704/209 |
| 4,018,996 | 4/1977 | Kahn | 179/84 VF |
| 4,566,117 | 1/1986 | Suckle | 704/268 |
| 4,817,155 | 3/1989 | Briar et al. | 381/36 |
| 4,852,170 | 7/1989 | Bordeaux | 704/277 |
| 4,933,973 | 6/1990 | Porter | 704/233 |
| 5,133,011 | 7/1992 | Mckiel, Jr. | 704/276 |
| 5,197,113 | 3/1993 | Mumolo | 395/2 |
| 5,222,190 | 6/1993 | Pawate et al. | 704/200 |
| 5,231,671 | 7/1993 | Gibson et al. | 381/49 |
| 5,448,679 | 9/1995 | McKiel | 704/208 |
| 5,692,104 | 11/1997 | Chow et al. | 704/255 |

*Primary Examiner*—Richemond Dorvil
*Attorney, Agent, or Firm*—Edward H. Duffield; Daniel E. Venglarik; Andrew J. Dillon

[57] ABSTRACT

When a speech signal that may include a sibilant consisting of one or more formants is received, frequencies and selectivity factors are determined for each sibilant formant in the speech signal. Then, the frequencies and selectivity factors are compared to a set of empirically derived criteria to classify the sibilant sound.

12 Claims, 5 Drawing Sheets

METHOD AND APPARATUS FOR SIBILANT CLASSIFICATION IN A SPEECH RECOGNITION SYSTEM

BACKGROUND OF THE INVENTION

1. Technical Field

The present invention relates in general to a method and apparatus for speech recognition, and in particular to a method and apparatus for sibilant classification of speech. Still more particularly, the present invention relates to a method and apparatus for sibilant classification of speech in a speech recognition system that is speaker independent.

2. Description of the Related Art

Human speech sounds originate in two different ways. They originate as either sonorant sounds or fricatives. Sonorant or "voiced" sounds are generated by the vocal chords as harmonic-rich periodic pressure waves. These pressure waves are then filtered by a number of resonant cavities in the upper respiratory tract. A speaker uses muscles in the throat and mouth to alter the resonant frequencies of these cavities and thereby form various vowel sounds. Fricatives, also called, sibilants, are the brief hissing sounds associated with pronouncing "S", "SH", "F", and "H" sounds. Basically, sibilant sounds result from turbulent flow that occurs when the speaker's breath is passed through a constriction. For example, the "H" sound is caused by a constriction between the tongue and palate. These aperiodic noises are filtered by small resonant cavities formed by the tongue, palate, teeth and lips. The filtering by the small resonant cavities enhances certain bands of frequencies within the noise to impart a noticeable coloration. Variations on this effect allow for differentiation of sibilant sounds.

Distinguishing between these different sibilant sounds has been a challenge for electronic speech recognition systems. Distinguishing between these sounds is important not only for distinguishing "S", "SH", "F", "H", but also the more abrupt derivatives of these sounds, such as "CH", "K" and "T". Some existing speech recognition systems treat sibilants lumped together with the voiced aspects of the sound to derive a collective summary vector for further processing. Such systems may be considered to be spectrum aware. In contrast, other speech recognition systems employ a filter to extract the higher frequencies, which may haphazardly include harmonics of the voiced signal, and assess the short-term amplitude envelope of the high frequencies without much regard for the spectral content. In telephone applications, both of these types of systems suffer poor sibilant recognition hindered by the limited bandwidth of the telephone channel. But with full bandwidth applications as in direct microphone input, the latter technique that ignores high frequency formants is at a distinct disadvantage. Furthermore, systems of both types have had difficulty in classifying sibilant sounds in a speaker-independent manner. Therefore, it would be advantageous to have a method and system for sibilant sound classification in a speech recognition system that is speaker independent.

SUMMARY OF THE INVENTION

It is an object of the present invention to provide a method and apparatus for speech recognition.

It is another object of the present invention to provide an improved method and apparatus for sibilant classification in speech signal analysis.

It is yet another object of the present invention to provide a method and apparatus for sibilant classification of speech in a speech recognition system that is speaker independent.

The present invention provides when a speech signal that may include a sibilant consisting of one or more formants is received, frequencies and selectivity factors are determined for each sibilant in the speech signal. Then, the frequencies are selectivity factors and compared to a set of empirically derived criteria to classify the sibilant sound.

The present invention also identifies an amplitude for the at least one sibilant in assigning a classification to the sibilant.

The present invention provides an apparatus that includes a signal separator having an input for speech data. This signal separator has an output for a signal containing voiced data and another output for a signal containing unvoiced data. In analyzing the voiced data, the voiced data is output from the signal separator on a first output to a first amplitude detector and a first spectrum analyzer. A voiced formant analyzer is connected to the first spectrum analyzer and the output from the first amplitude detector and the voiced formant analyzer are sent to an analysis recorder. For analyzing the unvoiced data signal, the unvoiced data signal is output from the signal separator on a second output to a second amplitude detector and a second spectrum analyzer. The spectrum analyzer is connected to a sibilant formant extractor that produces two sets of outputs in response to two sibilants present within the signal containing unvoiced data signal. An amplitude qualifier unit is connected to the outputs of the sibilant formant extractor and to the second amplitude detector. A sibilant classifier unit is connected to the output of the amplitude qualifier unit. The output of the sibilant classifier and of the second amplitude detector are connected to the analysis recorder. Time-lined analysis vectors are accumulated by the analysis recorder and are made available to the word pattern matching logic.

The above aspects as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DESCRIPTION OF PREFERRED EMBODIMENT

Figure 1:
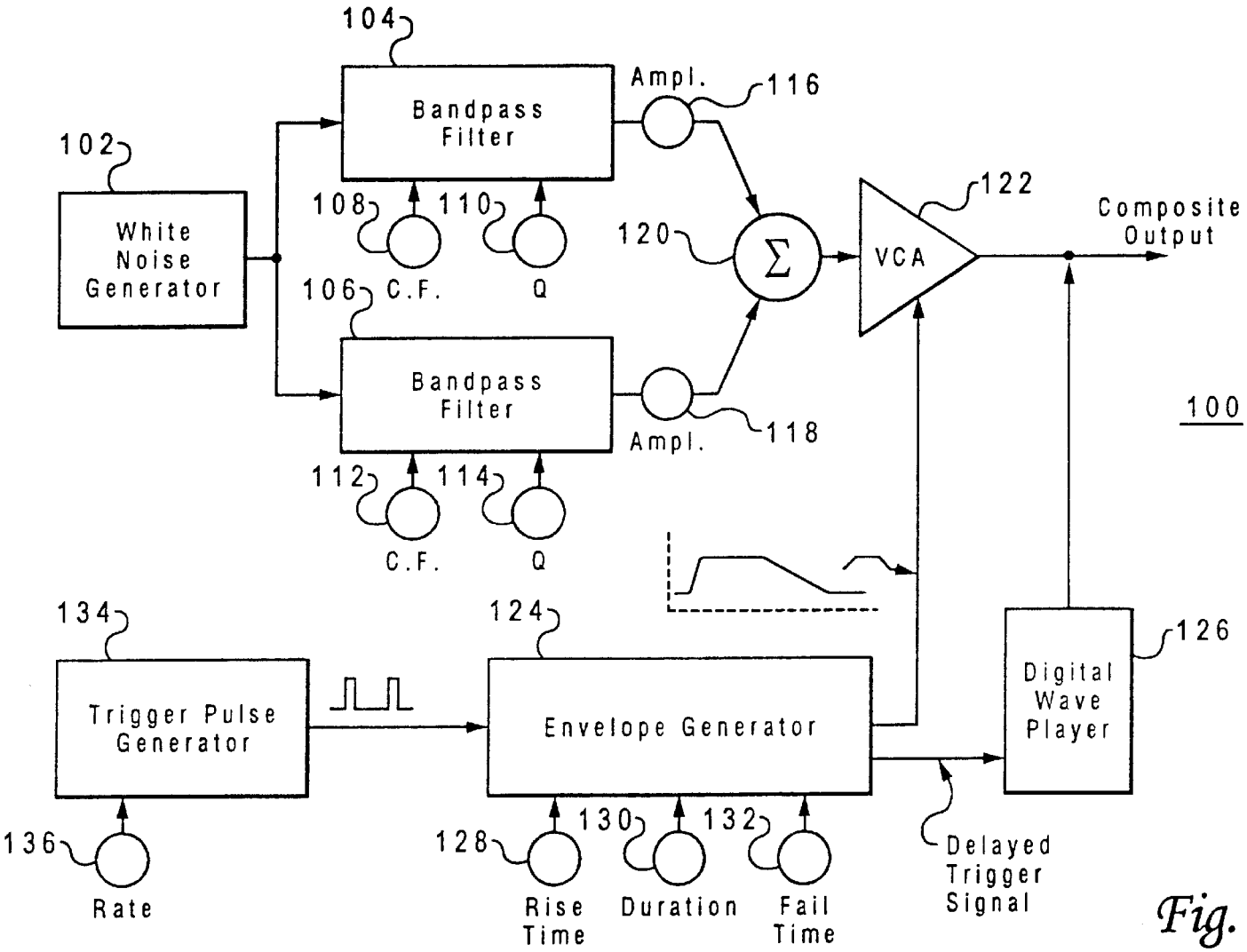
FIG. 1 is an illustration of a signal generator.

The present invention performs speaker-independent classification of sibilant sounds based upon empirical data regarding perceptual boundaries among human listeners. The present invention allows for measuring of perceptual boundaries from the perspective of a listener and for incorporating of the measurements into a speech recognition system. Sibilant sounds consist of white noise that is filtered by one or two filters. Each filter emphasizes a certain band of frequencies. The effect of each filter is characterized in terms of the center frequency and bandwidth, as is common in dealing with resonant responses in electronic circuits.

The "center frequency" of a given filter is the frequency that passes through the filter with the most gain, or least loss, in amplitude. In other words, the center frequency is the frequency that passes best through the filter. From this point of maximum response, the response drops off gradually as the frequency of the input signal is varied above or below the optimal center frequency.

The "bandwidth" is a measure of how selectively the filter passes some frequencies while excluding all others. In relative terms, the bandwidth is often said to be either narrow or wide. For example, if a particular filter passed frequencies in the range of 900 Hz to 1100 Hz, its bandwidth would be 200 Hz. Stated as such, this would seem to imply that frequencies of 899 Hz and below and of 1101 Hz and above would not be passed through the filter. However, the response of a simple resonant filter is typically a Gaussian shape, which tapers off gradually above or below the center frequency. This characteristic makes it difficult to distinguish well-defined upper and lower cut-off frequencies. The conventional method employed to measure the bandwidth of such a response curve is to find the upper and lower frequencies at which the response drops to one-half of what it is at the optimal center frequency. These points are commonly called the "half-power" points. These points are also called the "3db" points when the logarithmic decibel system is being used to express attenuation.

Another method employed to express the selectivity of a filter is known as the "Q" factor, also called the quality factor. The "Q" factor of a filter is the ratio of the center frequency divided by the bandwidth of the filter. The "Q" factor serves both to scale the bandwidth relative to the center frequency and to invert the expression so that higher "Q" factors represent greater selectivity. For example, assume that a filter "A" has cutoff frequencies of 900 Hz and 1100 Hz. The filter passes all frequencies in between. Assume another filter "B" has cutoff frequencies at 1,000,000 Hz to 1,000,200 Hz. Both filters have a bandwidth of 200 Hz. The first filter (Q=5), however, only restricts frequencies within the range of about 20 percent of its center frequency. The second filter (Q=5,000) only accepts frequencies within 0.02 percent of the center frequency. Thus, in proportion to center frequency the filter "B" is more selective than the filter "A".

In classifying sibilant sounds in a speech recognition system, it is necessary to (1) determine the presence of sibilant sounds, (2) determine the number of filter resonances comprising the sibilants, (3) determine the center frequency and the bandwidth of each imposed filter, and (4) apply classification boundaries as will be described below.

A number of ways are known to those skilled in the speech recognition art to detect the presence of sibilants keying on spectral activity above about 2 KHz. Most are adaptive dynamically during use or statically during training. In accordance with a preferred embodiment of the present invention, sibilant signals are separated from voiced signals using the residual from a phase-locked pitch extractor. This system can help avoid confusion of some higher frequency vowel formants as being sibilants.

Several common mathematical techniques are available for reducing an amplitude spectrum into the parameters of a few filters as is done for vowel formants using linear predictive coding or cepstral techniques. These techniques are known to those of ordinary skill in the speech recognition arts. In accordance with a preferred embodiment of the present invention, the amplitude spectrum is reduced into the parameters of a few filters by employing a spectral center-of-mass determination, "folding" the spectrum along the center-of-mass frequency, then performing a least-squares fit to a Gaussian function. This process may be iterated to extract a second resonance if the first pass leaves a substantial residual.

According to the present invention, two perceptual boundaries are used for classification once the center frequency (CF) and bandwidth of each significant resonance is determined. The two perceptual boundaries were derived from experiments with a signal generator in accordance with a preferred embodiment of the present invention.

With reference now to FIG. 1, a signal generator 100 for use in deriving perceptual boundaries is illustrated in accordance with the preferred embodiment of the present invention. In particular, signal generator 100 includes white noise generator 102, which has an output connected to bandpass filter 104, and bandpass filter 106. Bandpass filter 104 has an output connected to amplifier 116 and bandpass filter 106 has an output connected to amplifier 118. The output of these two amplifiers are connected to summing block 120, which in turn has its output connected to voltage controlled amplifier 122. Envelope generator 124 controls voltage controlled amplifier 122. This envelope generator also controls digital wave player 126.

The characteristics of bandpass filter 104 are controlled by CF control 108 and Q factor control 110. Similarly, bandpass filter 106 has its characteristics determined by CF control 112 and Q factor control 114. The bandpass characteristics of bandpass filter 104 and bandpass filter 106 may be adjusted until the desired sibilants are created.

Envelope generator 124 generates a signal that has a rise time, a duration, and a fall time. The rise time is controlled by rise time control 128, the duration is set by duration control 130, and the fall time is selected by fall time control 132. Trigger pulse generator 134 generates a pulse that activates envelope generator 124. The rate that pulses are sent to envelope generator 124 from trigger pulse generator 134 are controlled by rate control 136.

The signal sent to digital wave player 126 is delayed such that it is generated immediately after the sibilant is generated at the output of voltage controlled amplifier 122 so that effectively a single utterance is generated. The combination of these two signals originating from voltage controlled amplifier 122 and digital wave player 126 form the composite output to create various sounds used to determine perceptual boundaries for a given listener. For example, the sounds "SHERRY" and "CHERRY" may be generated by signal generator 100. The sibilant "SH" can be generated by adjusting the characteristics of bandpass filters 104 and 106. The "ERRY" sound is generated by digital wave player 126. Combining these two sources results in the composite output of signal generator 100 that sounds like the utterance "SHERRY". Then, by altering settings on envelope generator 124, it is possible to generate an utterance that sounds like "CHERRY". The characteristics of each of the bandpass filters may be adjusted to form the sibilants "H", "S", "F". By combining outputs from the two bandpass filters, other sibilants may be reproduced in accordance with a preferred embodiment of the present invention.

Figure 2:
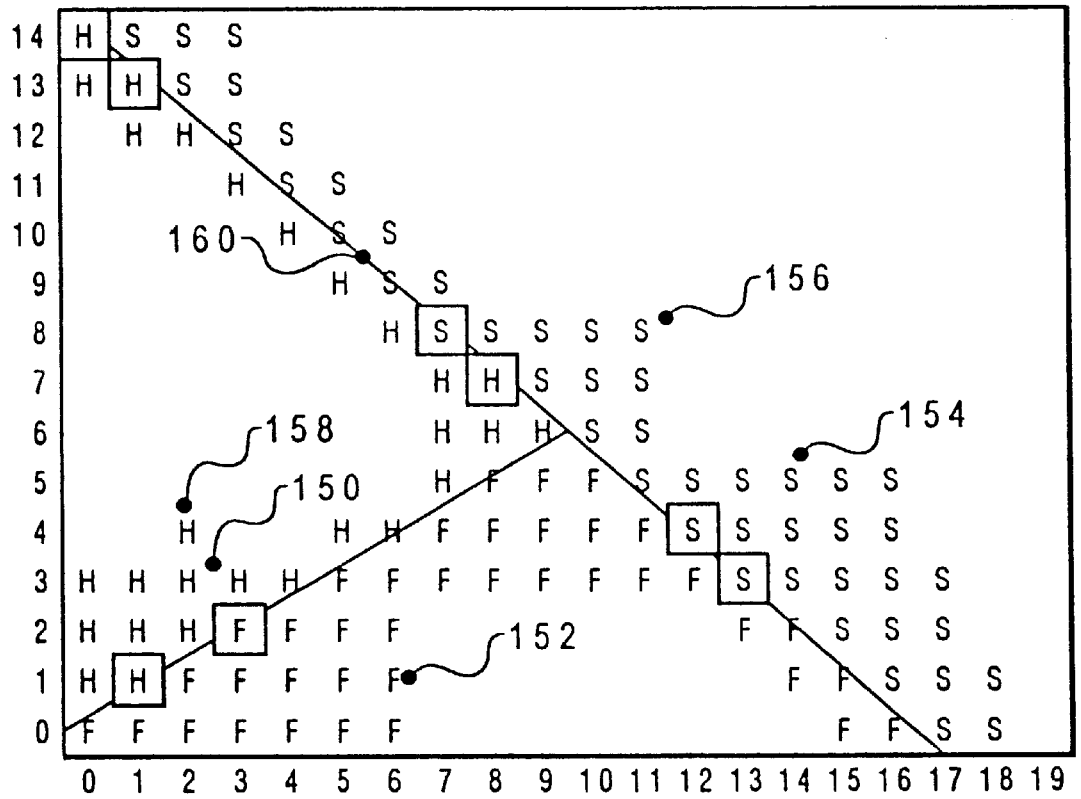
FIG. 2 is a graph of sibilant data.

With reference now to FIG. 2, a graph of sibilant data gathered using signal generator 100 is depicted in accordance with a preferred embodiment of the present invention. This data was gathered empirically using signal generator 100 and is based on the perception of listeners. The data is plotted in a transformed manner as a relationship of frequency (F) versus the Q factor (Q). In FIG. 2, three distinct regions are present for the various sibilants "H," "S," and "F." Data falling on the boundaries are a mix of the two different sibilants. For these sounds, a human listener can perceive either of the two sibilants depending on context or the listener's inclination. For example, data points 150 is clearly an "H," data point 152 is a "F," and data point 154 is a "S." As can be seen with reference to FIG. 2, definite boundaries between the various sibilants "S", "H", and "F" are present. Data point 160 could be either an "S" or an "H" depending on the context or the listener's inclination.

The "SH" sound is appropriately named as can be seen in the instance when two resonances are present. In such a situation, one resonance meets the criteria for an "S" and the other resonance is consistent with an "H". As a result, the sound is perceived as an "SH". If, however, one of the significant resonances is above 5 kHz, the sound is perceived as an "S" regardless of the addition of an "H" qualifying resonance.

As can be seen, other combinations of multiple resonances are not classifiable as sibilants by the human ear and are readily discounted as non-speech signals using the present invention.

Based upon empirical data obtained by the methods described above, the classification of sibilants in accordance with a preferred embodiment of the present invention is as follows:

If the fourth root of the "Q" factor is greater than (−0.00232*CF+14), then the sound is classified as an "S", otherwise If the fourth root of the "Q" factor is greater than (0.00145*CF+1), then the sounds is classified as an "H", otherwise the sound is classified as an "F".

Where CF is the center frequency of a resonant, and the "Q" factor is equal to the center frequency divided by the bandwidth. The fourth root is obtained in sibilant classifier 216 in FIG. 3 below.

Figure 3:
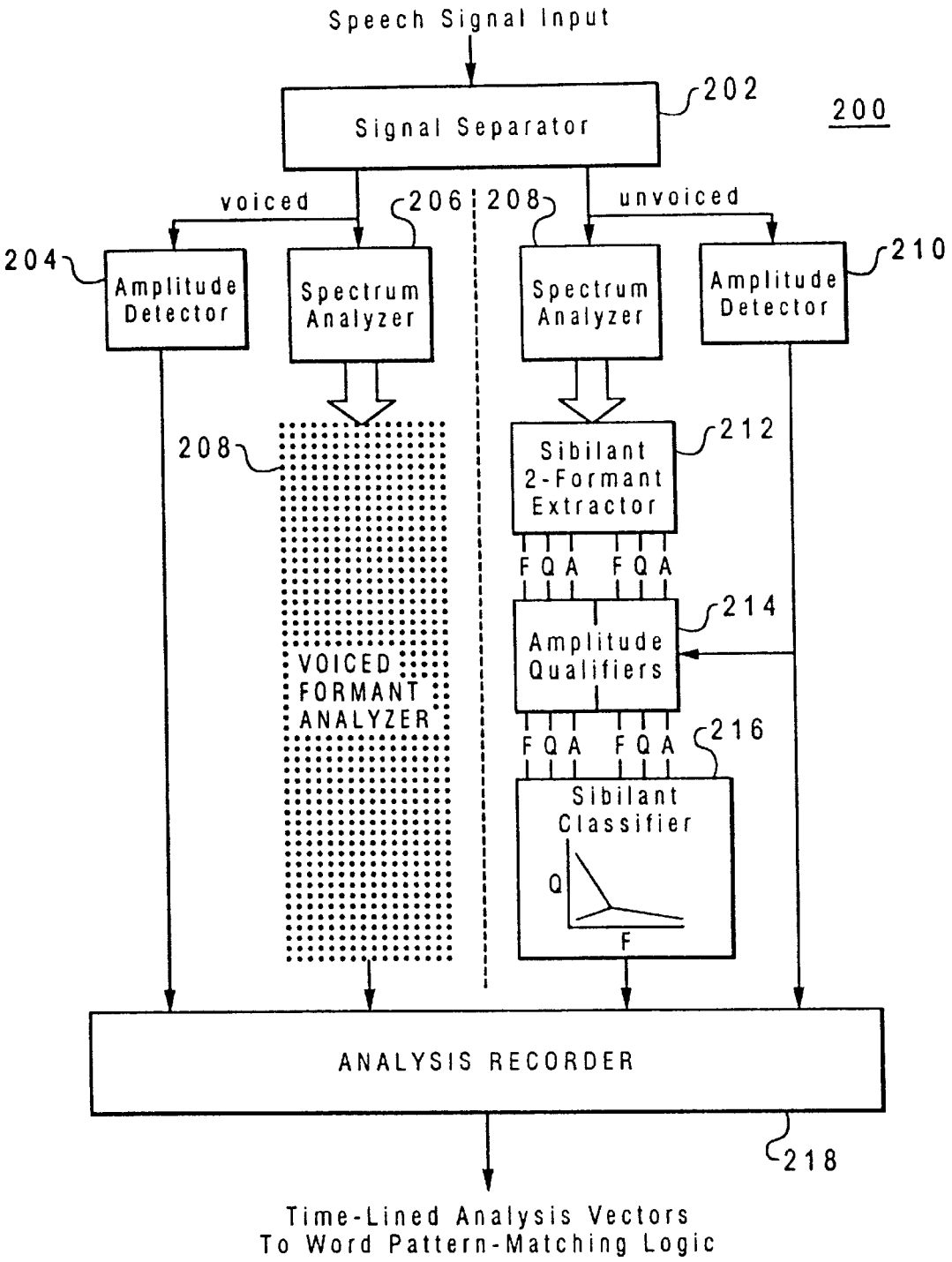
FIG. 3 is a block diagram of a speech processor using a sibilant classifier.

Turning now to FIG. 3, a block diagram of a speech processor utilizing a sibilant classifier is depicted in accordance with the preferred embodiment of the present invention. Speech processor 200 incorporates a signal separator 202, which divides the speech signal input into a voiced signal and an unvoiced signal. U.S. Pat. No. 5,133,011 shows an implementation of a signal separator system that may be employed for signal separator 202. The voiced signal is sent into amplitude detector 204 and spectrum analyzer 206 while the unvoiced signal is sent into spectrum analyzer 208 and amplitude detector 210. On the voiced side of speech processor 200, the output from spectrum analyzer 206 is sent into voiced formant analyzer 208.

On the unvoiced side, spectrum analyzer 208 has its output directed into sibilant two-formant extractor 212. Sibilant two-formant extractor 212 produces two sets of three outputs: frequency (F), Q factor (Q), and amplitude (A). These six outputs are sent into amplitude qualifier 214. This amplitude qualifier examines the amplitude of each formant relative to the overall unvoiced amplitude from detector 210. Amplitude qualifier 214 eliminates either or both formants if they are determined to be of an insignificant relative amplitude (i.e. 5 percent or less). The output from amplitude qualifiers 214 is sent into sibilant classifier 216. The output from amplitude detector 204, voiced formant analyzer 208, sibilant classifier 216, and amplitude detector 210 are all connected to analysis recorder 218. This analysis recorder accumulates and provides time-lined analysis vectors to word pattern-matching logic. More information on such an analysis recorder 218 can be found in U.S. Pat. No. 4,783,804. All of the components except for sibilant classifier 216 are well known to those skilled in the art. A more detailed description of the process is followed by the sibilant classifier is found in the description of FIG. 5 below.

Figure 4:
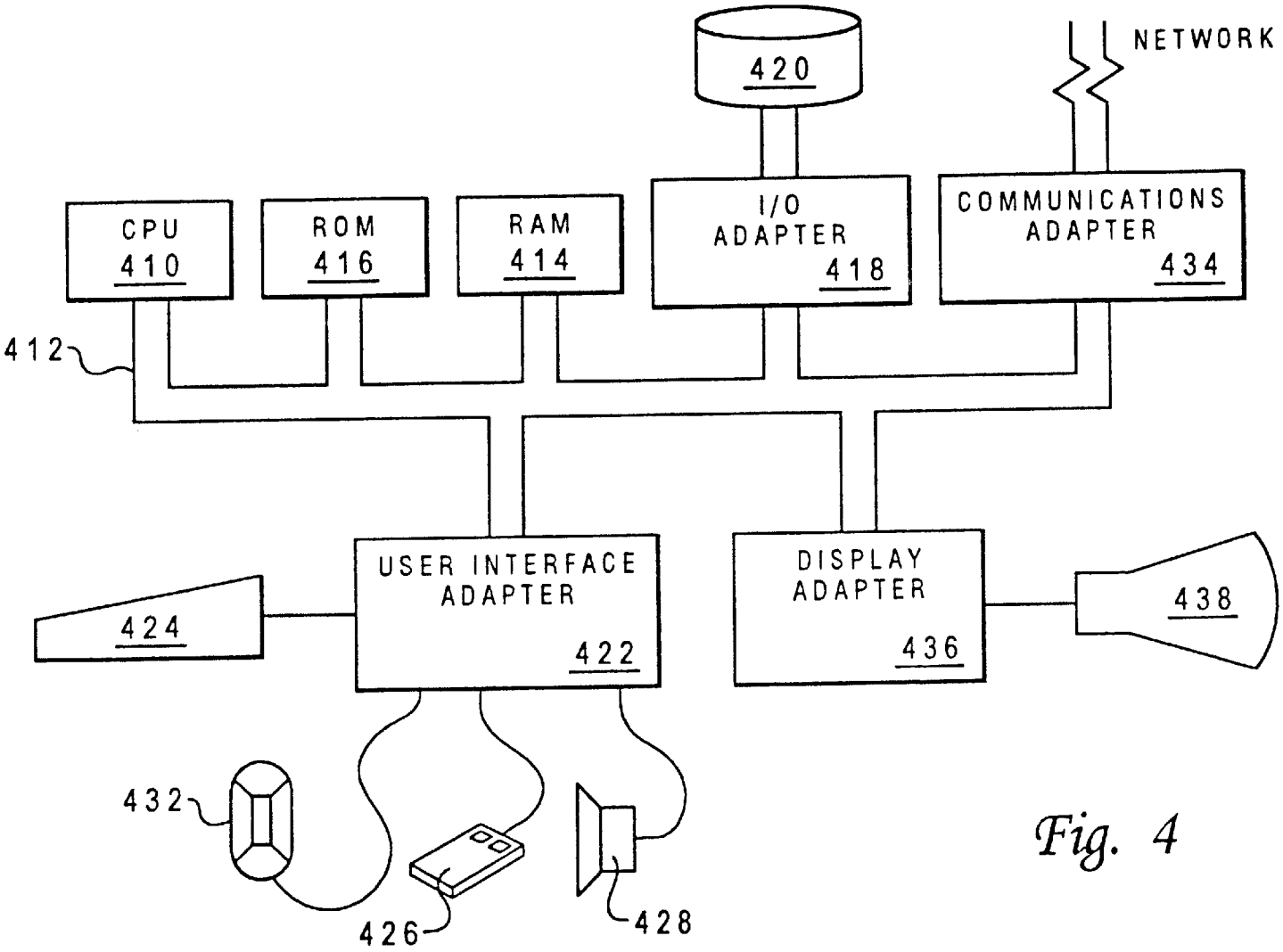
FIG. 4 is an illustration of a computer system in which processes of the present invention may be incorporated.

Turning next to FIG. 4, a computer system is illustrated in which the present invention may be incorporated. In particular, sibilant classifier 218 may be incorporated in the digital computer system. Alternatively, sibilant classifier 218 may be hardwired into circuitry. Other portions of speech processor 200 may be incorporated in software in computer system depicted in FIG. 4. Furthermore, signal generator 100 also may be incorporated using processes found in the computer system in FIG. 4.

With reference now to FIG. 4, a block diagram of a computer system is depicted in which a preferred embodiment of the present invention may be implemented. This figure is representative of a typical hardware configuration station of a workstation having a central processing unit 410, such as a conventional microprocessor and a number of other units interconnected via system bus 412. The particular computer system includes random access memory (RAM) 414, read only memory (ROM) 416, and I/O adapter 418 for connecting peripheral devices such as disk units 420 to the bus, a user interface adapter 422 for connecting a keyboard 424, a mouse 426, a speaker 428, a microphone 432, and/or other user interface devices such as a touch screen device (not shown) to the bus, a communication adapter 434 for connecting the computer system to a data processing network and a display adapter 436 for connecting the bus to a display device 438.

In accordance with a preferred embodiment of the present invention, the processes followed by sibilant classifier 218 in FIG. 3 may be performed within CPU 410 in FIG. 4. The instructions for performing these processes may be stored in ROM 416, RAM 414, or disk units 420. The disk units may include a hard disk drive, a floppy disk drive, or a CD-ROM drive. Other components of the present invention also may be implemented within the computer system depicted in FIG. 4. In particular, various functions such as signal separation, spectrum analysis, or bandpass filters may be implemented within this computer system.

Figure 5:
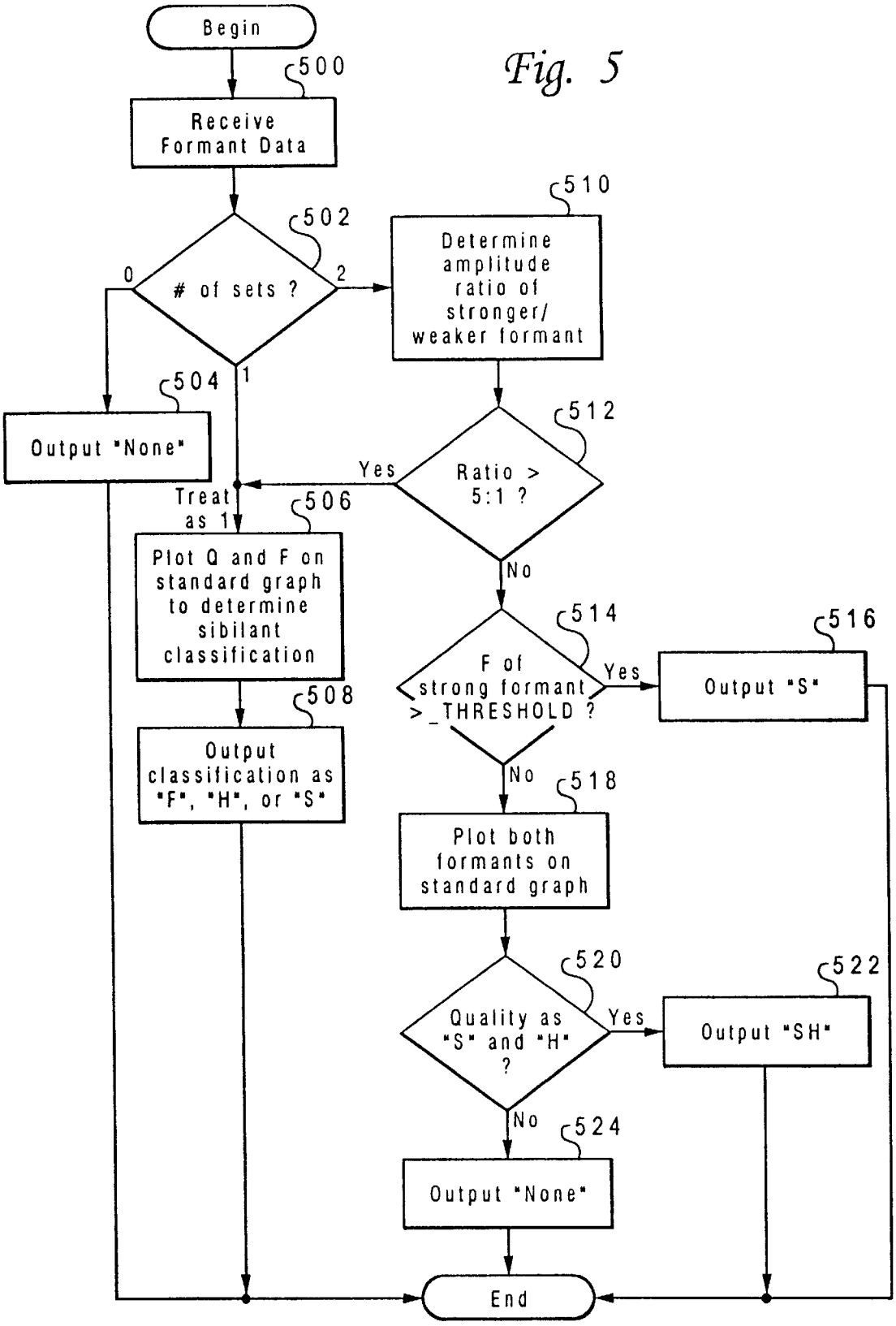
FIG. 5 is a flowchart of a process for classifying sibilant data.

With reference now to FIG. 5, a flowchart of a process for sibilant classifier 218 is illustrated in accordance with the preferred embodiment of the present invention. The process begins by receiving formant data (step 500). Formant data includes the Q factor, the frequency, and the amplitude of the signal or data to be analyzed. The number of sets present in the formant data is determined (step 502). If the number set is zero, the output is "none" (step 504). If the number of sets is equal to one, Q and F are plotted on a standard graph to determine sibilant classification (step 506). The process then outputs the classification as "F", "H", or "S" (step 508) with the process terminating thereafter.

With reference again to (step 502), if two sets of formant data are present, the process then determines the amplitude ratio of the stronger/weaker formant (step 510). Thereafter, a determination is made as to whether the ratio of the stronger to weaker formant is greater than a five to one ratio (step 512). If the ratio is not greater than a five to one ratio, the process then determines if the frequency of the strong formant is greater than a selected threshold, S_THRESHOLD. If the frequency of the strong formant is greater than the threshold, the process then outputs "S" as the identified sibilant (step 516). Otherwise, the process plots both formants on a standard graph (step 518).

Thereafter, a determination is made to qualify the two sets of data as "S" and "H" (step 520). If the qualification is "S" and "H," a "SH" is output as the identified formant (step 522). Otherwise, the output is "none" (step 524) with the process terminating thereafter. With reference again to (step 512), if the ratio of the stronger to weaker formant is greater than a ratio of five to one, the two sets of formant data are treated as a single set of formant data and the process proceeds to (step 506) as described above.

The processes depicted FIGS. 1, 3, and 5 may be implemented by those of ordinary skill in the art within a computer system depicted in FIG. 4. The processes of the present invention may be implemented in a program storage device that is readable by the computer system, wherein the program storage device encodes computer system executable instructions coding for the processes of the present invention. The program storage device may take various forms including, for example, but not limited to a hard disk drive, a floppy disk, an optical disk, a ROM, and an EPROM, which are known to those skilled in the art. The process is stored on a program storage device or dormant until activated by using the program storage device with the computer system. For example, a hard drive containing computer system executable instructions for the present invention may be connected to the computer system; a floppy disk containing the computer system executable instructions for the present invention may be inserted into a floppy disk drive and a new data processing system; or a ROM containing the data processing system executable instructions for the present invention may be connected to the data processing system.

While the invention has been particularly shown and described with reference to a preferred embodiment, it will be understood by those skilled in the art that various changes in form and detail may be made therein without departing from the spirit and scope of the invention.

What is claimed is:

1. A method for classifying sibilants comprising:

receiving a speech signal including at least one sibilant;

identifying a quality factor for a formant of the at least one sibilant;

identifying a center frequency for the formant of the at least one sibilant; and assigning an identity to the at least one sibilant using the quality factor and the center frequency identified for the formant of the at least one sibilant.

2. The method of claim 1, further comprising identifying an amplitude for the formant of the at least one sibilant and wherein the assigning step further includes using the amplitude to assign an identity to the at least one sibilant.

3. The apparatus of claim 1, further comprising identifying an amplitude for the formant of the at least one sibilant and wherein the assignment means further includes means for using the amplitude identified for the formant of the at least one sibilant to assign an identity to the at least one sibilant.

4. A method for classifying sibilants comprising:

receiving a speech signal including at least one sibilant;

identifying a quality factor for a formant of the at least one sibilant;

identifying a center frequency for the formant of at least one sibilant; and assigning an identity to the at least one sibilant using the quality factor and the center frequency identified for the formant of at least one sibilant by:

determining a quality factor for the formant of a sibilant;

classifying the sibilant as an "S" in response to a determination that a fourth root of the quality factor is greater than minus 0.00232 times the center frequency for the formant of the sibilant plus 14;

identifying a sibilant as an "H" in response to a determination that a fourth root of the quality factor is greater than 0.00145 times the center frequency for the formant of the sibilant plus 1; and otherwise classifying the sibilant as an "F".

5. An apparatus for classifying sibilants comprising:

reception means for receiving a speech signal including at least one sibilant;

first identification means for identifying a quality factor for a formant of the at least one sibilant;

second identification means for identifying a center frequency for the formant of the at least one sibilant; and assignment means for assigning an identity to the at least one sibilant using the quality factor and the center frequency identified for the formant of the at least one sibilant.

6. A speech processing apparatus comprising:

a signal separator having an input for speech data and a first output for a signal containing voiced data and a second output for a signal containing unvoiced data;

a first amplitude detector having an input connected to the first output of the signal separator;

a first spectrum analyzer having an input connected to the first output of the signal separator;

a voiced formant analyzer having an input connected to the output of the first spectrum analyzer;

a second spectrum analyzer having an input connected to the second output of the signal separator;

an amplitude detector having an input connected to the second output of the signal separator;

a sibilant formant extractor having an input connected to the output of the spectrum analyzer, wherein the sibilant formant extractor produces two sets of outputs in response to two sibilants being present within the signal containing the unvoiced data;

an amplitude qualifier unit having an input connected to the output of the sibilant formant extractor and an input connected to the output of the second amplitude detector;

a sibilant classifier unit having an input connected to the output of the amplitude qualifier unit; and an analysis recorder having inputs connected to the first and second amplitude detector, the voice formant analyzer, and the sibilant classifier unit.

7. A storage device readable by a data processing system and encoding data processing system executable instructions for identifying sibilants the storage comprising:

means for receiving a speech signal including at least one sibilant;

means for identifying a quality factor for a formant of the at least one sibilant;

means for identifying a center frequency for the formant of the at least one sibilant;

means for assigning an identity to the at least one sibilant using the quality factor and the center frequency identified for the formant of the at least one sibilant, wherein the means are activated when the storage device is connected to and accessed by the data processing system.

8. The storage device of claim 7, wherein the storage device is hard disk drive.

9. The storage device of claim 7, wherein the storage device is a ROM for use within the data processing system.

10. The storage device of claim 7, wherein the storage device is a floppy diskette.

11. The storage device of claim 7, wherein the storage device is a RAM.

12. A speech processing apparatus comprising:

a signal generator for generating sibilants to form utterances, wherein the signal generator generates an utterance;

a reception means for receiving the utterance from the signal generator;

first identification means for identifying a quality factor for a formant of a sibilant received as part of the utterance;

second identification means for identifying a center frequency for the formant of the sibilant;

assignment means for assigning an identity to the sibilant using the quality factor and the center frequency identified for the formant of the sibilant; and storage means for storing the identity of the sibilant in association with the quality factor and the center frequency identified for the formant of the sibilant, wherein the stored identity may be employed to efficiently provide speaker independent speech recognition.

* * * * *